United States Patent [19]

Ichijima et al.

[11] 4,310,619

[45] Jan. 12, 1982

[54] COLOR PHOTOGRAPHIC MATERIAL AND PROCESS INCORPORATING A NOVEL MAGENTA COUPLER

[75] Inventors: Seiji Ichijima; Yoshiharu Yabuki; Toshiyuki Watanabe; Nobuo Furutachi, all of Minami-ashigara, Japan

[73] Assignee: Fuji Photo Film Co., Ltd., Kanagawa, Japan

[21] Appl. No.: 126,934

[22] Filed: Mar. 3, 1980

[30] Foreign Application Priority Data

Mar. 5, 1979 [JP] Japan ..... 54-25426

[51] Int. Cl.[3] ..... G03C 7/00; G03C /140

[52] U.S. Cl. ..... 430/387; 430/222; 430/241; 430/393; 430/472; 430/474; 430/476; 430/505; 430/555; 430/558

[58] Field of Search ..... 430/555, 558, 387, 505, 430/393, 222, 241, 472, 474, 476

[56] References Cited

U.S. PATENT DOCUMENTS

| | | | |
|---|---|---|---|
| 3,990,899 | 11/1976 | Shiba et al. | 430/387 |
| 4,049,458 | 9/1977 | Boie et al. | 430/557 |
| 4,076,533 | 2/1978 | Ota et al. | 430/558 |
| 4,133,686 | 1/1979 | Ichijima et al. | 430/557 |

FOREIGN PATENT DOCUMENTS

| | | | |
|---|---|---|---|
| 2536191 | 3/1976 | Fed. Rep. of Germany | 430/555 |

*Primary Examiner*—J. Travis Brown

*Attorney, Agent, or Firm*—Sughrue, Mion, Zinn, Macpeak & Seas

[57] ABSTRACT

A color photographic material and a method of forming a color photographic image which utilizes a 5-pyrazolone magenta coupler shown by the following general formula (I):

(I)

wherein R represents an acylamino group, an anilino group or a ureido group; $R_1$, $R_2$ and $R_3$, which may be the same or different, each represents a hydrogen atom, a halogen atom, an alkyl group, an alkenyl group, a cycloalkyl group, an aralkyl group, an alkoxy group, an aryloxy group, a carboxy group, an aryl group or a heterocyclic group (which groups may be substituted) and Rand $R_2$ may combine to form a 2-indazolyl group, provided that $R_1$, $R_2$ and $R_3$ are not hydrogen atoms at the same time; and Ar represents a phenyl group which may be substituted with one or more halogen atoms, alkyl groups, alkoxy groups or cyano groups. These 5-pyrazolone magenta couplers are two-equivalent magenta couplers and particularly suitable for providing silver halide color photographic light-sensitive materials having high sensitivity.

25 Claims, No Drawings

COLOR PHOTOGRAPHIC MATERIAL AND PROCESS INCORPORATING A NOVEL MAGENTA COUPLER

BACKGROUND OF THE INVENTION

1. Field of the Invention

The present invention relates to a color image-forming process and a silver halide photograhic light-sensitive material utilizing a novel two-equivalent magenta color forming coupler.

2. Description of the Prior Art

It is known that, upon color development of a silver halide color photographic material, an oxidized aromatic primary amine color developing agent reacts with a coupler to form an indophenol, indoaniline, indamine, azomethine, phenoxazine, phenazine or like dye, with color images being formed. In this system, color reproduction is usually based on subtractive color photography, and silver halide emulsions selectively sensitive to blue, green and red light, respectively, and yellow, magenta and cyan color image-forming compounds which are in a complementary color relation to the sensitivity of the respective emulsions are employed. For example, acylacetanilide or dibenzoylmethane couplers are used for the formation of a yellow color image, pyrazolone, pyrazolobenzimidazole, cyanoacetophenone and indazolone couplers are mainly used for the formation of magenta color images, and phenolic couplers (e.g., phenols and naphthols) are mainly used for the formation of cyan color images.

In one of the most preferred embodiments of color photographic light-sensitive materials, dye image-forming couplers are added to silver halide emulsions. Couplers added to emulsions must be rendered non-diffusible (or diffusion-resistant).

Almost all conventional color image-forming couplers are 4-equivalent couplers. That is, the development of 4 moles of silver halide as an oxidizing agent is theoretically necessary to form 1 mol of dye through the coupling reaction. On the other hand, 2-equivalent couplers having an active methylene group substituted with a group eliminatable upon the oxidative coupling with an oxidation product of an aromatic primary amine developing agent requires the development of only 2 mols of silver halide to form 1 mol of dye. Since 2-equivalent couplers require only one-half the silver halide as compared with ordinary 4-equivalent couplers to form a dye, their use enables rapid processing of light-sensitive materials due to the thinness of the light-sensitive layers, the photographic properties improved due to a reduction in film thickness, and the economic advantages achieved.

Several approaches have thus far been suggested to produce the 2-equivalent 5-pyrazolone couplers primarily used as magenta-forming couplers. For example, the substitution of the 4-position of a pyrazolone with a thiocyano group is described in U.S. Pat. Nos. 3,214,437 and 3,253,924, with an acyloxy group is described in U.S. Pat. No. 3,311,476, with an aryloxy group is described in U.S. Pat. No. 3,419,391, with a 2-triazolyl group is described in U.S. Pat. No. 3,617,291, and with a halogen atom is described in U.S. Pat. No. 3,522,052.

However, in using these 4-position substituted pyrazolone couplers, the disadvantages that serious color fog results, that the reactivity of the couplers is unsuitable, that the couplers are chemically so unstable that they are converted to materials incapable of color formation with the lapse of time, or that synthesis of the couplers often is difficult occur.

Also, it has hitherto been known to substitute the 4-position of a 5-pyrazolone with an alkylthio group, an arylthio group or a heterocyclic ring thio group as described in U.S. Pat. No. 3,227,554. However, with many of these known thio-substituted pyrazolone compounds, the reactivity with the oxidation product of an aromatic primary amino color developing agent is unsuitable and, further, they are difficult to employ in ordinary color light-sensitive materials due to the strong photographic action of the mercapto compound produced as a result of the coupling reaction. In addition, the chemical stability of these couplers is not satisfactory.

Recently, 2-equivalent 5-pyrazolone magenta couplers having a heterocyclic substituent at the 4-position thereof have been disclosed in some patents. For example, an imidazoyl group and a derivative thereof, a 1,2,4-triazolyl group and a derivative thereof and a 1,2,3-triazolyl group and a derivative thereof are described in German Patent Application (OLS) No. 2,536,191, and a 1,2,4-triazolyl group and a derivative thereof are described in German Patent Application (OLS) No. 2,651,363.

The compounds described in the above-mentioned patents show good color forming properties to a certain degree and thus satisfy one of the characteristics required of 2-equivalent magenta couplers. However, those couplers having an imidazolyl group or a 1,2,4-triazolyl group still also have some disadvantages, for example, they are accompanied by a decrease in the sensitivity of the silver halide due to interaction with silver halide (for example, the adsorption on the light-sensitive center of silver halide, etc.).

The couplers according to the present invention are improved couplers which have few of the disadvantages described above with respect to the fundamental characteristics required for use in photographic light-sensitive materials.

SUMMARY OF THE INVENTION

Therefore, an object of the present invention is to provide a novel 2-equivalent magenta coupler in which the coupling position is substituted with a group eliminatable upon coupling with an oxidation product of an aromatic primary amine developing agent.

Another object of the present invention is to provide a novel 2-equivalent magenta coupler having suitable reactivity and capable of forming a dye in high yield without forming undesired fog or stain.

A further object of the present invention is to provide a color photographic light-sensitive material having a silver halide emulsion layer containing a novel magenta color image-forming coupler.

A still further object of the present invention is to provide a process for reducing the amount of silver halide in a photographic emulsion layer by using a novel magenta color image-forming coupler therein, thus improving the sharpness of color images to be obtained.

A still further object of the present invention is to provide a color photograph having a fast color image by using a novel magenta color image-forming coupler.

An even further object of the present invention is to provide a novel 2-equivalent magenta coupler which can be synthesized with ease and in high yield.

Also an object of the present invention is to provide a 2-equivalent magenta coupler showing improved degree of conversion to the dye, having improved resistance to a reduction in coloration due to the attack of chemicals, and having excellent coloration reactivity.

Also an object of the present invention is to provide a color photographic light-sensitive material having high sensitivity using a novel 2-equivalent magenta coupler.

These and other objects of the present invention will become apparent from the following detailed description and examples.

These objects of the present invention are attained using a novel photographic coupler represented by the general formula (I) described below and, particularly, by a color photographic light-sensitive material comprising a support having thereon at least one silver halide emulsion layer with at least one of the silver halide emulsion layers containing a novel 2-equivalent magenta coupler represented by the general formula (I) described below.

The couplers according to the present invention are represented by the following general formula (I):

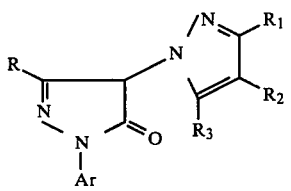

(I)

wherein R represents an acylamino group, an anilino group or a ureido group; $R_1$, $R_2$ and $R_3$, which may be the same or different, each represents a hydrogen atom, a halogen atom, an alkyl group, an alkenyl group, a cycloalkyl group, an aralkyl group, an alkoxy group, an aryloxy group, a carboxy group, an aryl group or a heterocyclic group (these groups may be substituted) and $R_1$ and $R_2$ may combine with each other to form a 2-indazolyl group provided that $R_1$, $R_2$ and $R_3$ are not hydrogen atoms at the same time; Ar represents a phenyl group which may be substituted with one or more halogen atoms, alkyl groups, alkoxy groups or cyano groups.

DETAILED DESCRIPTION OF THE INVENTION

Examples of the acylamino groups for R include, for example, an aliphatic acylamino group having 2 to 30 carbon atoms or an aromatic acylamino group having 6 to 32 carbon atoms which may be substituted with a halogen atom, an acylamino group, an alkoxy group, an aryloxy group, an aryl group, a sulfonamido group, a sulfamoyl group, an alkoxycarbonyl group, a imido group, a cyano group, a carboxy group, an alkylcarbonyl group, an aryloxycarbonyl group, a sulfo group, an acyloxy group, a carbamoyl group, a ureido group, a urethane group, a heterocyclic group, an alkylsulfonyl group, an arylthio group, an alkylthio group, an anilino group, a hydroxy group, an arylsulfonyl group, etc., such as an acetamido group, a benzamido group, a 3-[α-(2,4-di-tert-amylphenoxy)butyramido]benzamido group, a 3-[α-(2,4-di-tert-amylphenoxy)acetamido]benzamido group, a 3-[α-(3-pentadecylphenoxy)-butyramido]benzamido group, an α-(2,4-di-tert-amylphenoxy)butyramido group, an α-(3-pentadecylphenoxy)butyramido group, etc.

The anilino groups for R may be substituted with a straight or branched chain alkyl, alkenyl, aralkyl or aryl group, and the same groups as described above for the acylamino group, and have 6 to 32 total carbon atoms (inclusive of the anilino moiety). Representative examples include an anilino group, a 2-chloroanilino group, a 2,4-dichloroanilino group, a 2-chloro-5-tetradecanamidoanilino group, a 2-chloro-5-(2-octadecenylsuccinimido)anilino group, a 2-chloro-5-[α-(3-tert-butyl-4-hydroxy)tetradecanamido]anilino group, a 2-chloro-5-tetradecyloxycarbonylanilino group, a 2-chloro-5-(N-tetradecylsulfamoyl)anilino group, a 2,4-dichloro-5-tetradecyloxyanilino group, etc.

The ureido groups for R may be substituted by the same groups as the above-described acylamino group. Representative examples include a 3-[(2,4-di-tert-amylphenoxy)acetamido]phenylureido group, a phenylureido group, a methylureido group, an octadecylureido group, a 3-tetradecanamidophenylureido group, etc.

The group connected at the 4-position of the 5-pyrazolone ring represented by the general formula (I) is in more detail represented by the following general formula (II):

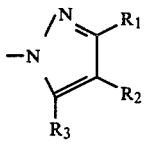

(II)

wherein $R_1$, $R_2$ and $R_3$, which may be the same or different, each represents a hydrogen atom, a halogen atom, a straight chain or branched chain alkyl group having 1 to 35 carbon atoms, preferably 1 to 22 carbon atoms, an alkenyl group having 2 to 22 carbon atoms such as a 1-pentenyl group, an octadecenyl group, etc., a cycloalkyl group having 5 to 22 carbon atoms such as a cyclohexyl group, a cyclopentyl group, etc., or an aralkyl group having 7 to 22 carbon atoms such as a benzyl group, a phenethyl group, etc., provided that $R_1$, $R_2$ and $R_3$ are not hydrogen atoms at the same time. These groups can bear one or more substituents. Examples of the substituents include a halogen atom, a nitro group, a cyano group, a thiocyano group, an aryl group, such as a phenyl group, a naphthyl group, etc., an alkoxy group having 1 to 10 carbon atoms such as a methoxy group, a butoxy group, etc., an aryloxy group having 6 to 10 carbon atoms such as a phenoxy group, etc., a carboxy group, an alkylcarbonyl group having 2 to 10 carbon atoms such as an acetyl group, a butanoyl group, etc., an arylcarbonyl group having 7 to 10 carbon atoms such as a benzoyl group, a naphthoyl group, etc., an alkoxycarbonyl group having 2 to 10 carbon atoms such as a methoxycarbonyl group, etc., an aryloxycarbonyl group having 7 to 11 carbon atoms such as a phenylcarbonyl group, a naphthoxycarbonyl group, etc., a sulfo group, an acyloxy group having 2 to 10 carbon atoms such as an acetyloxy group, a benzoyloxy group, etc., a sulfamoyl group, a carbamoyl group, an acylamino group, a diacylamino group, a ureido group, a thioureido group, a urethane group, a thiourethane group, a sulfonamido group, a 5- or 6-membered heterocyclic group which may be saturated or unsaturated and may contain one or two hetero atoms (e.g., a nitrogen atom, an oxygen atom or a sulfur atom), an arylsulfonyloxy group, an alkylsulfonyloxy group, an arylsulfonyl group, an alkylsulfonyl group, an arylthio group, an alkylthio group, an alkylsulfinyl group, an arylsulfinyl group, an alkylamino group, a dialkylamino group, an anilino group, an N-alkylanilino group, an N-arylanilino group, an N-acylanilino group, a hydroxy group, a mercapto group, etc.

Further, $R_1$, $R_2$ and $R_3$ each may represent an alkoxy group (in which the alkyl moiety can be a straight chain or branched chain alkyl group having 1 to 22 carbon atoms and can bear one or more of the substituents as described for the above alkyl group), an aryloxy group (in which the mono- or bicyclic aryl moiety having 6 to 10 carbon atoms represents, for example, a phenyl group or a naphthyl group and can bear one or more of the substituents as described above for the alkyl group) or a carboxy group.

Furthermore, $R_1$, $R_2$ and $R_3$ each may represent a mono- or bicyclic aryl group having 6 to 10 carbon atoms (for example, a phenyl group, an α-naphthyl group, a β-naphthyl group, etc.) or a 5- or 6-membered heterocyclic group which may be saturated or unsaturated and may contain one or two hetero atoms (e.g., a nitrogen atom, an oxygen atom or a sulfur atom) (for example, an oxazolyl group, a thiazolyl group, a furyl group, an α-pyridyl group, etc.), and these groups can bear one or more alkyl groups having 1 to 22 carbon atoms such as a methyl group, a dodecyl group, etc., alkenyl groups having 2 to 22 carbon atoms such as an octadecenyl group, etc., cycloalkyl groups having 5 to 22 carbon atoms such as a cyclopentyl group, a cyclohexyl group, etc., aralkyl groups having 7 to 22 carbon atoms such as a benzyl group, a phenethyl group, etc., as well as the substituents as described for the above alkyl group.

Ar in the general formula (I) represents in more detail a phenyl group which may be substituted with one or more halogen atoms (for example, fluorine atoms, chlorine atoms, bromine atoms), straight chain or branched chain alkyl groups having 1 to 35 carbon atoms, preferably 1 to 22 carbon atoms, alkoxy groups containing a straight chain or branched chain alkyl group having 1 to 35 carbon atoms, preferably 1 to 22 carbon atoms or cyano groups.

Preferred examples of the substituted pyrazolyl group represented by the general formula (II) are illustrated below.

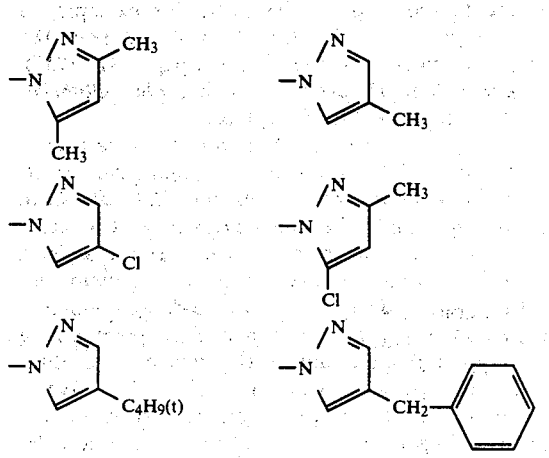

-continued

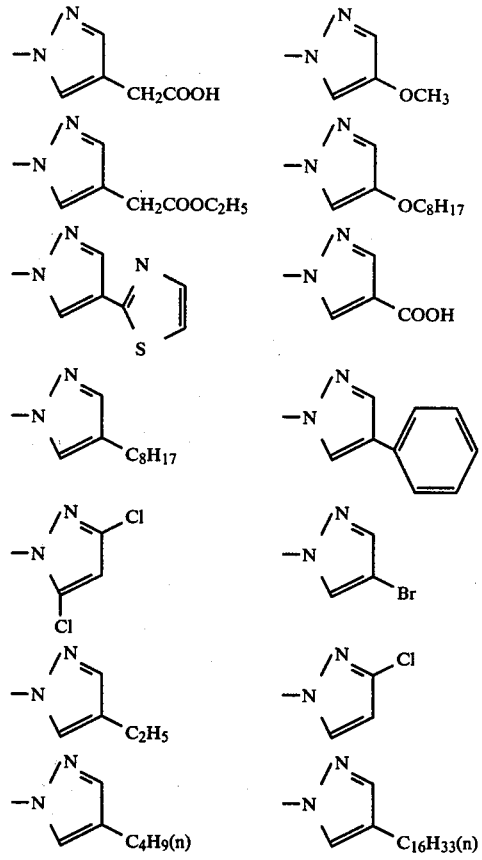

In the general formula (II), $R_1$ and $R_2$ can be connected to each other to form a group represented by the following general formula (III):

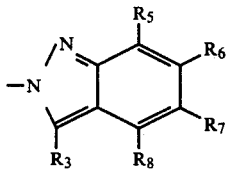

(III)

wherein $R_5$, $R_6$, $R_7$ and $R_8$, which may be the same or different, each represents a hydrogen atom, a straight or branched chain alkyl group having 1 to 10 carbon atoms such as a methyl group, a t-octyl group, etc., a straight or branched chain alkenyl group having 2 to 10 carbon atoms such as a 2-ethylhexyl group, etc., a cycloalkyl group having 3 to 10 carbon atoms such as a cyclohexyl group, etc., an aralkyl group having 7 to 11 carbon atoms such as a benzyl group, a phenethyl group and can bear one or more of the abovedescribed substituents for the alkyl group for $R_1$, $R_2$ or $R_3$ and $R_3$ in the formula (III) is as described for $R_3$ in the formula (I).

The 5-pyrazolone couplers having a group represented by the general formula (II) are particularly preferred in view of the effects according to the present invention.

The coupler of the present invention represented by the general formula (I) can be a symmetrical or an asymmetrical complex coupler formed by linking two coupler moieties to each other by the substituents of R and Ar or through an R or Ar divalent group.

The magenta couplers used in the present invention provide various properties depending upon the particular R, $R_1$, $R_2$, $R_3$ and Ar substituents and can be employed for various photographic purposes. When at least one of Ar and R contains a hydrophobic residue having 8 or more carbon atoms, the coupler is non-diffusible and is associated with a hydrophilic colloidal layer of the light-sensitive material. Such a coupler can be incorporated in a silver halide emulsion layer. Couplers having a diffusion-resistant hydrophobic residue in $R_1$, $R_2$ or $R_3$ and containing a water-solubilizing group such as a sulfo group or a carboxy group in at least one of Ar and R provide a diffusible dye through an oxidative coupling reaction with an aromatic primary amine developing agent, although the couplers themselves are non-diffusible. Such couplers which are capable of providing diffusible dyes are useful for diffusion transfer color photography.

The process of forming dye images through oxidative coupling reaction with an aromatic primary amine developing agent can be classified into two types depending on the manner of addition of the couplers. One type is a so-called incorporated-coupler process wherein the couplers are incorporated in an emulsion layer during the production of a light-sensitive material. The other type is a so-called unincorporated-coupler process wherein the couplers are dissolved in a developer and are supplied, upon development, through diffusion into an emulsion layer. Both types can be used in the present invention.

Couplers for use in the incorporated-coupler type system must be immobilized in an emulsion layer, i.e., must be made diffusion-resistant. Otherwise, couplers would migrate through a light-sensitive material and form color in the wrong emulsion layer having a different color sensitivity, thus seriously degrading the color reproducibility of the light-sensitive material. In order to render the couplers diffusion-resistant, a group having a hydrophobic residue containing 8 to 32 carbon atoms is introduced into the coupler molecule. Such a residue is called a ballasting group. This ballasting group can be connected to the coupler skeletal structure directly or through an imino bond, an ether bond, a carbonamido bond, a sulfonamido bond, a ureido bond, an ester bond, an imido bond, a carbamoyl bond, a sulfamoyl bond, or the like.

Several specific examples of the ballasting group are as described in the specific examples of the couplers of the present invention.

Typical examples of the ballasting groups include, e.g., an alkyl group, an alkoxyalkyl group, an alkenyl group, an aryl group substituted by an alkyl group, an aryl group substituted by an alkoxy group, a terphenyl group, and the like. These ballasting groups may be substituted by, for example, a halogen atom (e.g., fluorine, chlorine, etc.), a nitro group, a cyano group, an alkoxycarbonyl group, an amido group, a carbamoyl group, a sulfonamido group, etc. Specific examples of the ballasting group include an n-octyl group, a 2-ethylhexyl group, a tertoctyl group, an n-nonyl group, an n-decyl group, an n-dodecyl group, a 1,1-dimethyldecyl group, a 2,2-dimethyldecyl group, an n-octadecyl group, a 2-(n-hexyl)decyl group, an n-octadecyl group, a 9,10-dichlorooctadecyl group, a heptyloxyethyl group, a 2,4-di-tert-amylcyclohexyldodecyloxypropyl group, an oleyl group, a 2,4-di-tert-butylphenyl group, a 2,4-di-tert-amylphenyl group, a 2,4-di-tert-amyl-6-chlorophenyl group, a 3-n-pentadecylphenyl group, a 2-dodecyloxyphenyl group, a 3-heptadecyloxyphenyl group, an o-terphenyl group, a perfluoroheptyl group, etc.

The couplers according to the present invention can be obtained, in general, by the reaction of a magenta coupler having a halogen atom in the coupling position with a pyrazole compound according to the following reaction scheme:

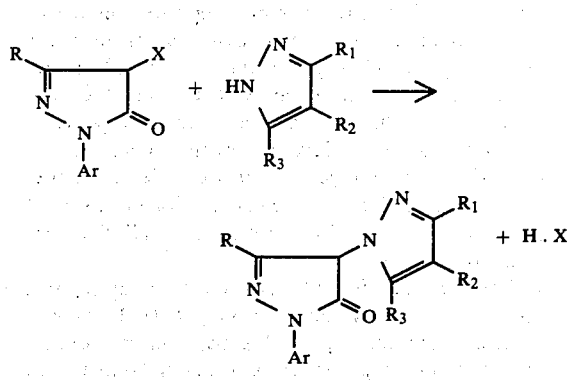

wherein R, $R_1$, $R_2$, $R_3$ and Ar each has the same meaning as defined above, and X represents a halogen atom (for example, a chlorine atom, a bromine atom, etc.) substituted in the coupling position of the magenta coupler. The 4-halogeno-5-pyrazolones can be synthesized from a 5-pyrazolone ring according to the process described in, for example, U.S. Pat. Nos. 3,006,759 and 3,522,051, and Japanese Patent Application (OPI) Nos. 63377/78 (The Term "OPI" as used herein refers to a "published unexamined Japanese patent application") and 93768/77. Also, when an electron-donating group such as an anilino group is substituted in the 3-position of a 5-pyrazolone, the mono-halo-substituted couplers can be synthesized with ease by converting the coupler to a 3-N-alkoxycarbonyl-anilino-5-pyrazolone derivative or a 3-N-trichloroacetyl-anilino-5-pyrazolone derivative, and halogenating the resulting 3-substituted coupler. Halogenation of the coupler is illustrated in the Synthesis Examples described hereinafter. For example, a bromination reaction can be accomplished in the presence of 2 to 20 ml of a solvent such as chloroform, dichloromethane, acetic acid, etc., per 1 g of 5-pyrazolone and in the presence or absence of bases such as sodium acetate, triethylamine, etc., under a temperature of −5° to 20° C.

The pyrazole compounds can be synthesized with reference to the methods described, for example, in *Justus Liebigs Annalen Der Chemie,* Vol. 598, page 186 (1956), *Naturewissenschaften,* Vol. 44, page 442 (1957), *Tetrahedron,* Vol. 11, page 231 (1960), *Zhur Obshcher Khim,* Vol. 26, page 3355 (1956), etc.

The reaction between the thus produced 4-halogeno-5-pyrazolone and the pyrazole compound can be effected at a temperature of from about 0° C. to 200° C. in various solvents or in the absence of a solvent by melting the reactants. Preferred temperatures range from about 20° C. to 150° C. and, where the reactants are reacted by non-solvent melting methods, the temperature needs to be no higher than the melting point as long as both reactants are soluble at that temperature. Illustrative preferred solvents include alcoholic solvents (e.g., methanol, ethanol, propanol, etc.), aromatic solvents (e.g., benzene, toluene, xylene, etc.), aprotic polar solvents (e.g., dimethylformamide, hexamethylphosphotriamide, etc.), and the like.

Since the pyrazole compounds present in an excess amount can be used as a dehydrohalogenating agent, it is not necessary to use a base. However, the base such as 1,8-diazabicyclo(5,4,0)-7-undecene-2,6-lutidine, sodium acetate, etc., can be used, if desired.

The coupler of the present invention can advantageously be mixed with a solvent dispersion by dissolving the coupler in a water-immiscible organic solvent having a melting point of about 170° C. or higher, a low-boiling organic solvent or a water-soluble organic solvent, or in a high-boiling, water-immiscible organic solvent and/or a low-boiling and/or water-soluble, organic solvent.

Any of the high-boiling, water-immiscible organic solvents described in U.S. Pat. No. 2,322,027 can be used as a solvent. Preferred solvents include di-n-butyl phthalate, benzyl phthalate, triphenyl phosphate, tri-o-cresyl phosphate, diphenyl mono-p-t-butylphenyl phosphate, monophenyl di-o-chlorophenyl phosphate, dioctyl phthalate, dibutyl sebacate, acetyl tributyl citrate, tri-t-octyl trimellitate, n-nonylphenol, dioctylbutyl phosphate, N,N-diethyllaurylamide, 3-pentadecylphenyl ethyl ether, 2,5-di-sec-amyl-phenyl butyl ether, etc.

Low-boiling organic solvents (having a boiling point of not higher than about 170° C.) or water-soluble organic solvents usable together with or in place of the high-boiling solvents are described in U.S. Pat. Nos. 2,801,171, 2,801,170, 2,949,360, etc. Examples of these organic solvents include the following solvents.

(1) Low-boiling, substantially water-insoluble organic solvents such as methyl acetate, ethyl acetate, propyl acetate, butyl acetate, isopropyl acetate, ethyl propionate, sec-butyl alcohol, ethyl formate, butyl formate, nitromethane, nitroethane, carbon tetrachloride, chloroform, etc.

(2) Water-soluble organic solvents such as methyl isobutyl ketone, β-ethoxyethyl acetate, propoxyethyl acetate, tetrahydrofurfuryl adipate, Carbitol acetate (ethylene-glycol monoacetate), methoxytriglycol acetate, methyl Cellosolve acetate, acetylacetone, diacetonealcohol, butyl Carbitol, butyl Cellosolve, methyl Carbitol, methyl ethyl ketone, methanol, ethanol, acetonitrile, dimethylformamide, dioxane, etc.

The water content present in the solvent solution should be sufficiently low enough that the solubility of the coupler is not affected.

After production, the low-boiling or water-soluble solvent can be removed from a cooled noodle-like dispersion by air-drying or continuously washing with water as described in, e.g., U.S. Pat. No. 2,801,171.

A homogenizer for emulsification, a colloid mill, an ultrasonic wave emulsifying apparatus, etc., are useful for dispersing oil-soluble couplers. Diffusion-resistant couplers having a carboxylic acid group or a sulfonic acid group in their molecule together with a ballasting group are soluble in a natural or a weakly alkaline aqueous solution. These couplers can be incorporated into a photographic emulsion by adding an aqueous solution thereof to the photographic emulsion. These couplers are believed to be rendered diffusion-resistant through formation of micelles in a hydrophilic high molecular weight material.

Examples of couplers of the present invention include the following compounds but the present invention is not to be construed as being limited to these couplers.

Compound (1)

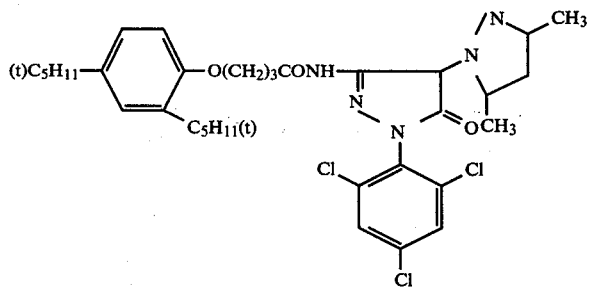

Compound (2)

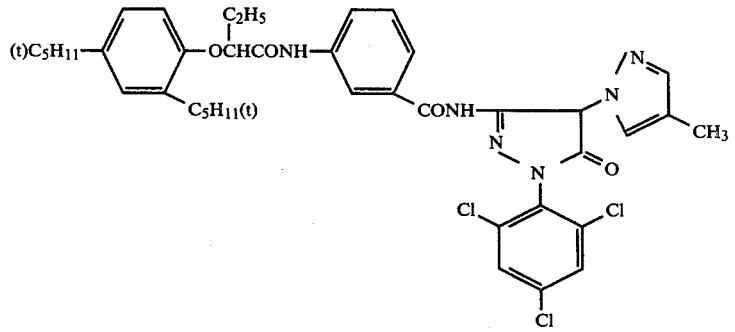

Compound (3)

-continued
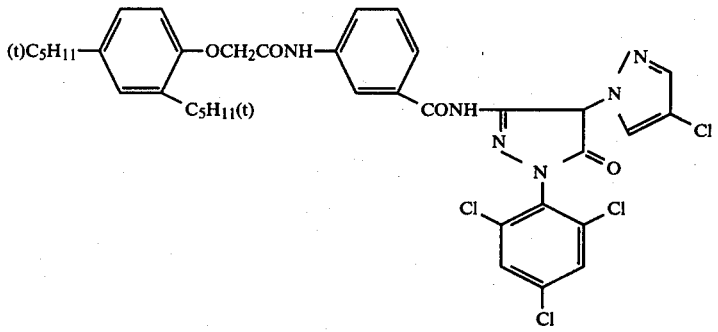
Compound (4)
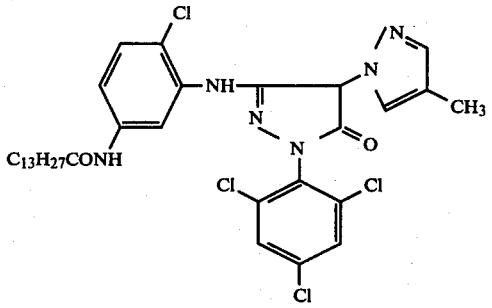
Compound (5)
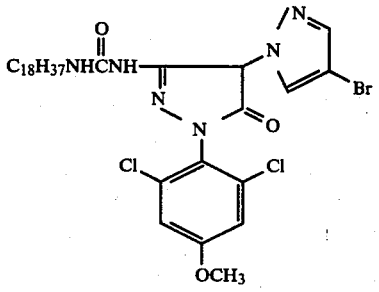
Compound (6)
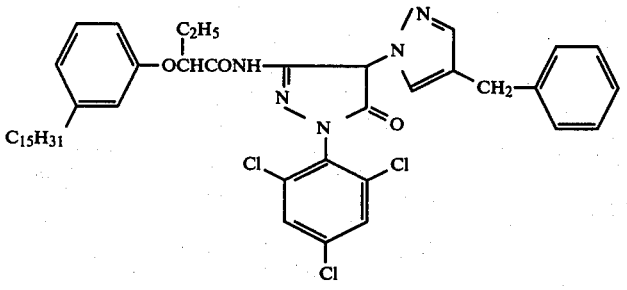
Compound (7)
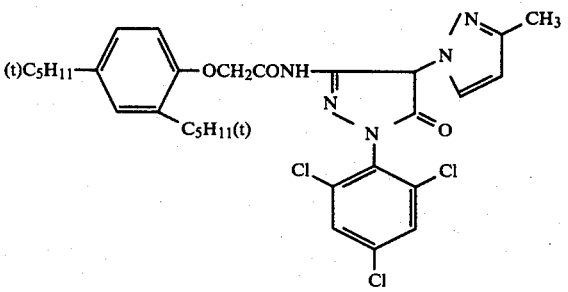
Compound (8)

-continued
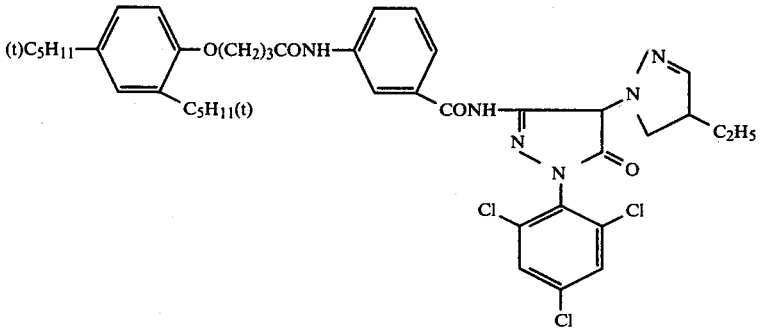
Compound (9)
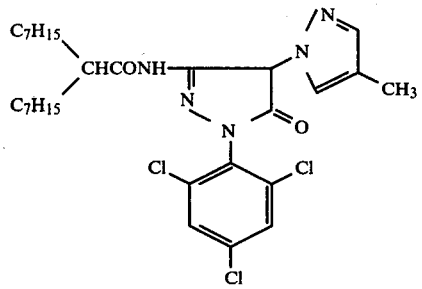
Compound (10)
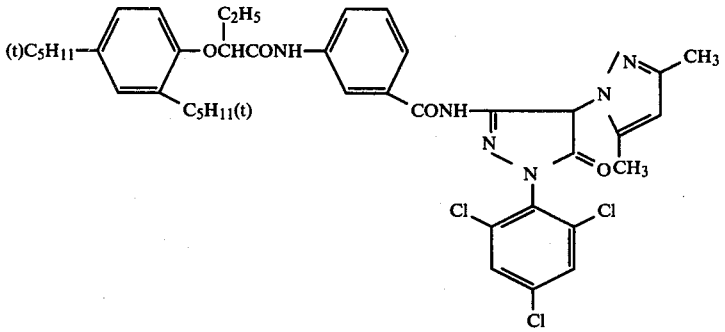
Compound (11)
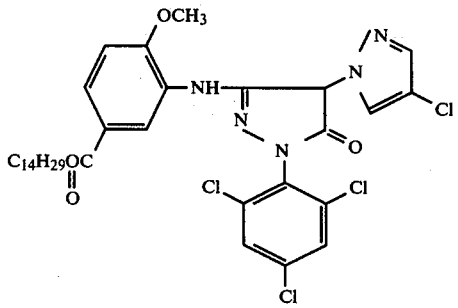
Compound (12)
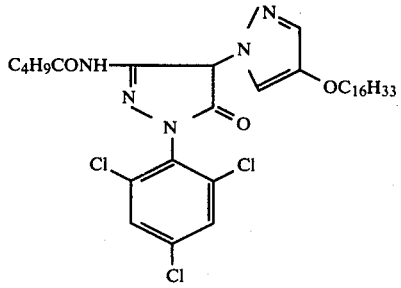
Compound (13)

-continued
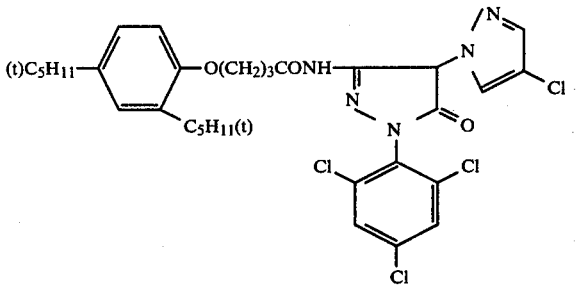
Compound (14)
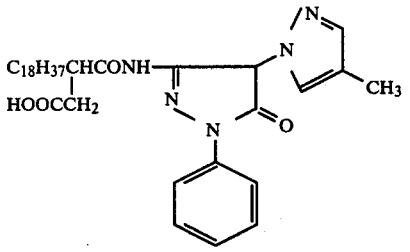
Compound (15)
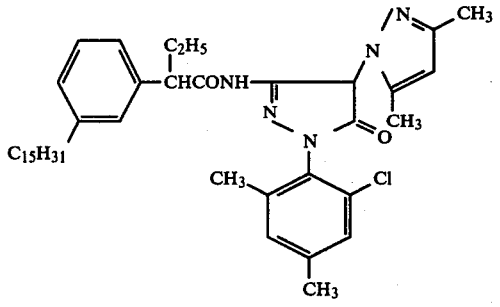
Compound (16)
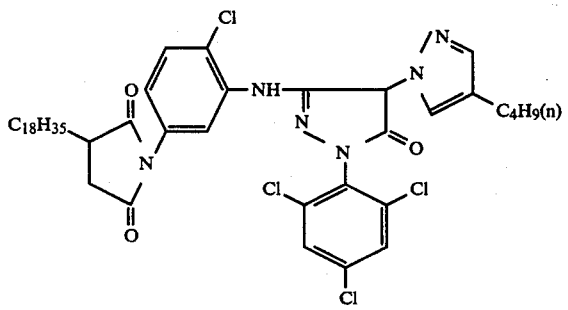
Compound (17)
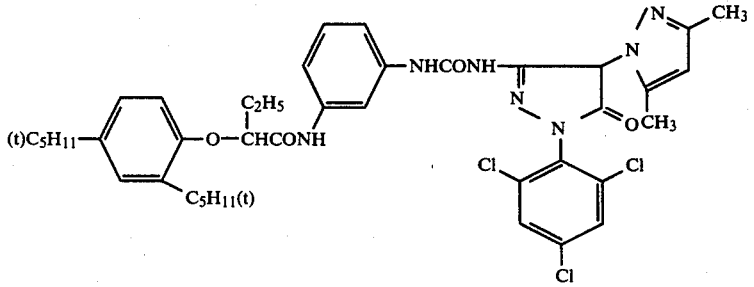
Compound (18)

-continued
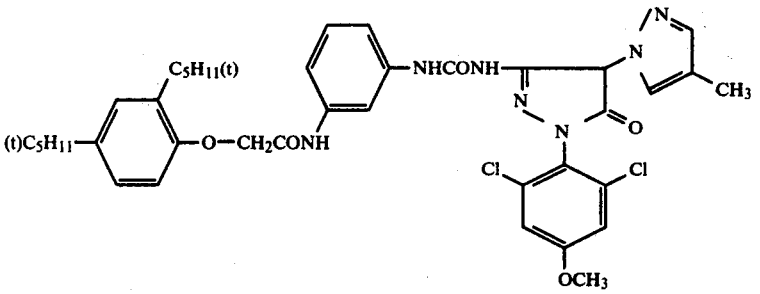
Compound (19)
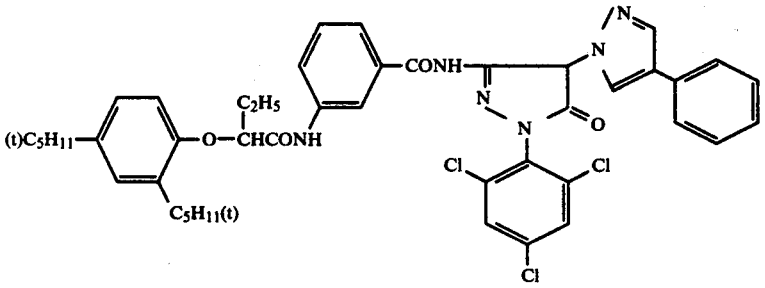
Compound (20)
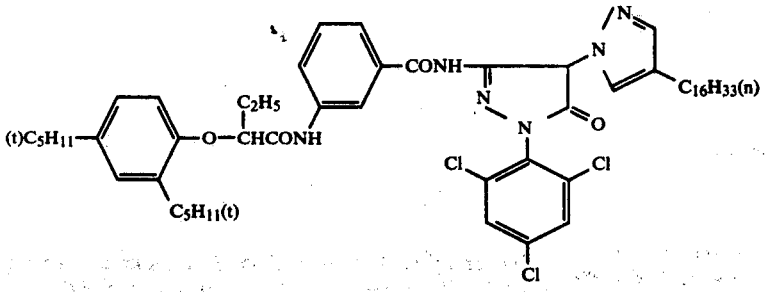
Compound (21)
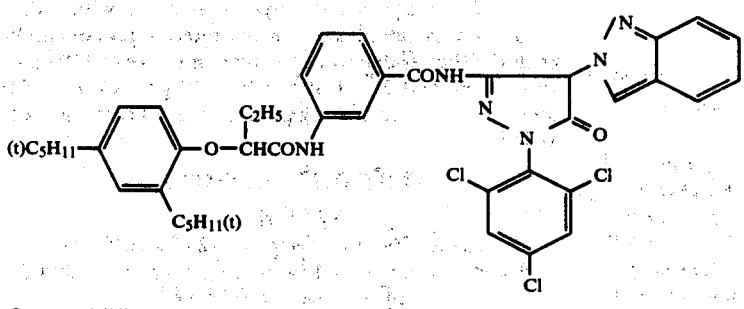
Compound (22)
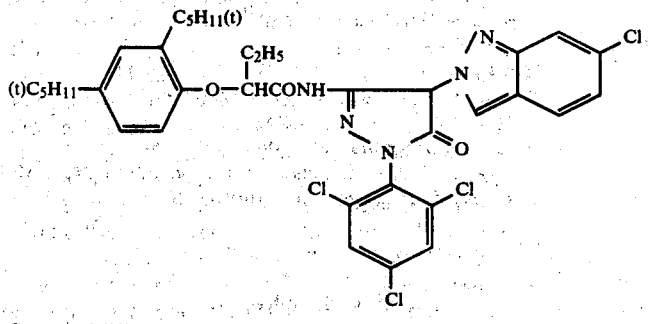
Compound (23)

-continued

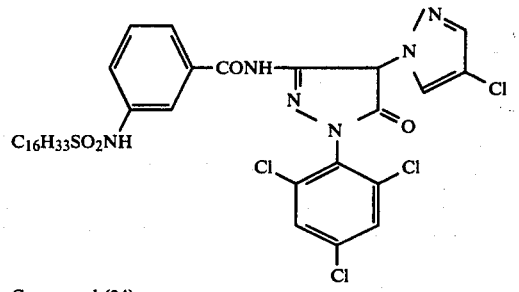

Compound (24)

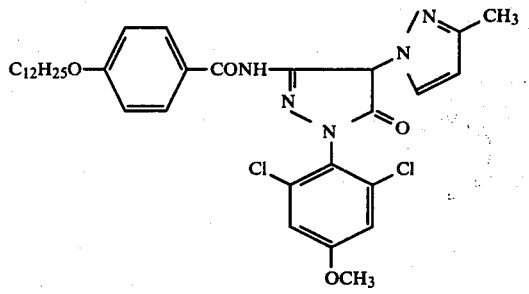

Compound (25)

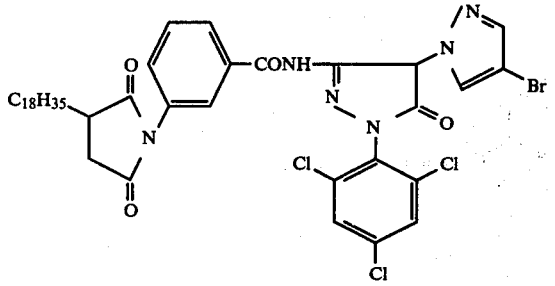

Typical examples of the synthesis of the photographic couplers of the present invention are described below.

SYNTHESIS EXAMPLE 1

Synthesis of 1-(2,4,6-Trichlorophenyl)-3-[4-(2,4-di-tert-amylphenoxy)butyramido]-4-(3,5-dimethylpyrazolyl)-5-oxo-2-pyrazoline [Coupler (1)]

66 g of 1-(2,4,6-trichlorophenyl)-3-[4-(2,4-di-tert-amylphenoxy)butyramido]-4-bromo-5-oxo-2-pyrazoline and 27 g of 3,5-dimethylpyrazole were mixed well with each other in a mortar, then stirred for 2 hours under heating at 100° C. To the reaction mixture was added 1 liter of ethyl acetate followed by washing several times with water. The ethyl acetate layer was dried with anhydrous sodium sulfate and concentrated. Upon crystallization of the residue from ethyl acetate, 35 g of Coupler (1) was obtained. The melting point of the coupler was 207° to 209° C.

SYNTHESIS EXAMPLE 2

Synthesis of 1-(2,4,6-Trichlorophenyl)-3-{3-[2-(2,4-di-tert-amylphenoxy)butyramido]benzamido}-4-(4-methylpyrazolyl)-5-oxo-2-pyrazoline [Coupler (2)]

45 g of 1-(2,4,6-trichlorophenyl)-3-{3-[2-(2,4-di-tert-amylphenoxy)butyramido]benzamido}-4-bromo-5-oxo-2-pyrazoline and 19 g of 4-methylpyrazole were mixed with each other, then stirred for 2 hours under heating at 90° C. To the reaction mixture was added 500 ml of ethyl acetate, followed by washing several times with water. The ethyl acetate layer was dried with anhydrous sodium sulfate and concentrated. Upon crystallization of the residue from a solvent mixture of 100 ml of acetonitrile and 20 ml of benzene, 19 g of Coupler (2) was obtained. The melting point of the coupler was 142° to 145° C.

SYNTHESIS EXAMPLE 3

Synthesis of 1-(2,4,6-Trichlorophenyl)-3-(2-chloro-5-tetradecanamidoanilino)-4-(4-methylpyrazolyl)-5-oxo-2-pyrazoline [Coupler (4)]

30 g of 1-(2,4,6-trichlorophenyl)-3-[N-acetyl(2-chloro-5-tetradecanamido)anilino]-4-bromo-5-oxo-2-pyrazoline prepared by the method described in Japanese Patent Application (OPI) No. 91862/77 was mixed well with 15 g of 4-methylpyrazole. The mixture was heated at 90° C. for 4 hours. After cooling, 300 ml of a 7% solution of potassium hydroxide dissolved in methanol was added to the reaction mixture and the mixture was stirred at room temperature for 3 hours. To the reaction mixture was added 1 liter of ethyl acetate, followed by washing with 1 liter of 1 N hydrochloric acid. After washing several times with water, the oil layer was dried with anhydrous sodium sulfate and concentrated. Upon crystallization of the residue from 100 ml of acetonitrile, 16 g of Coupler (4) was obtained. The melting point of the coupler was 121° to 125° C.

SYNTHESIS EXAMPLE 4

Synthesis of
1-(2,4,6-Trichlorophenyl)-3-{3-[2-(2,4-di-tert-amylphenoxy)butyramido]benzamido}-4-(3,5-dimethylpyrazolyl)-5-oxo-2-pyrazoline [Coupler (10)]

The coupler was synthesized in the same manner as described in Synthesis Example 2 except using the equimolar amount of 3,5-dimethylpyrazole in place of 4-methylpyrazole. The desired coupler was obtained by recrystallization from methanol. The melting point of the coupler was 225° to 229° C.

SYNTHESIS EXAMPLE 5

Synthesis of
1-(2,4,6-Trichlorophenyl)-3-[4-(2,4-di-tert-amylphenoxy)butyramido]-4-(4-chloropyrazolyl)-5-oxo-2-pyrazoline [Coupler (13)]

The coupler was synthesized in the same manner as described in Synthesis Example 1 except using the equimolar amount of 4-chloropyrazole in place of 3,5-dimethylpyrazole. The desired coupler was obtained by recrystallization from acetonitrile. The melting point of the coupler was 119° to 125° C.

The couplers of the present invention are 2-equivalent couplers. That is, they require stoichiometrically only 2 equivalents of silver halide as an oxidizing agent to produce 1 molecule of dye.

In comparison with conventionally widely used 4-equivalent pyrazolone type couplers, the 2-equivalent couplers of the present invention require only about one-half the amount of silver halide, thus the amount of silver halide incorporated in a light-sensitive material can be reduced to about one-half that amount required with 4-equivalent couplers. Therefore, not only is the production cost of light-sensitive materials reduced, but also light scattering is reduced as well improving the sharpness of the images.

The magenta coupler of the present invention can be converted to an azomethine dye in a high yield through an oxidative coupling reaction wherein exposed silver halide acts as an oxidizing agent. With some conventionally used 4-equivalent couplers, a leuco dye which is an intermediate in dye formation undergoes side reactions with an azine ring or the like being formed, resulting in a low conversion yield to the dye. On the other hand, the magenta couplers of the present invention can be converted to an azomethine dye in high yield since such a reactive intermediate is not formed. As a result, the amount of the magenta-forming coupler used in the color light-sensitive material of the present invention can be reduced, which leads to a reduction in silver halide content and in the thickness of an emulsion layer and thus to a reduction of the production cost of the light-sensitive materials, an improvement in the sharpness and facilitating rapid development processing.

The magenta coupler of the present invention has such a strong coupling activity for an oxidized aromatic primary amine color developing agent that the oxidation product of the developing agent produced upon color development is rapidly removed, thus accelerating the development of the silver halide emulsion.

Suitable amounts of the magenta coupler of the present invention are $2\times10^{-3}$ to $5\times10^{-1}$ mol, particularly $1\times10^{-2}$ to $5\times10^{-1}$ mol per mol of silver.

With the magenta coupler of the present invention, the process of forming a dye is completed in a color developing bath, which enables the materials to be processed with a bleach-fixing bath containing a weak oxidizing agent such as Fe (III) chelate of ethylenediaminetetraacetic acid (EDTA) or the like and a silver complex salt-forming agent or a ferric salt (e.g., ferric chloride) without using a bleaching bath containing a strong oxidizing agent such as potassium ferricyanide or potassium dichromate. This results in a shortening of the time required for the processing steps of color development and minimizes the problem of environmental pollution due to discharge of processing waste water.

The coupling position substituted magenta couplers of the present invention are less inactivated by the action of carbonyl compounds such as aldehydes or ketones. Conventionally used coupling position unsubstituted magenta couplers are often changed into a compound having a low color reaction activity such as a methylol or methylenebis compound when contacted with a formaldehyde or the like in the air especially in an emulsion layer, thus failing to attain sufficient coloration through color development. The color light-sensitive material of the present invention has the advantage that it is affected to a much lesser extent by such chemicals.

The coupling position substituted magenta coupler of the present invention has the property that, when it is used for ordinary color light-sensitive materials as described in the Examples, the coupler has a high stability with the lapse of time and undergoes only a slight reduction in coloring property when stored at a low temperature under high humidity as compared with particularly the above-described known couplers. The stability of a color light-sensitive material after production is one of the most important factors in evaluating the characteristics of light-sensitive materials. Also, colored images resulting from the magenta coupler of the present invention have markedly superior heat-fastness as compared with particularly couplers which are not substituted in the coupling position. Even in comparison with the above-described known couplers with the same pyrazolone nucleus and having a substituent in the 4-position, the colored image from the magenta coupler of the present invention is found to exhibit greater heat resistance.

Suitable amounts of silver for the photographic materials of the present invention are $1\times10^{-3}$ to $3\times10^{-1}$ mol/m$^2$.

The couplers in accordance with the present invention can be employed in light-sensitive materials containing a reduced amount of silver halide, i.e., about several tenths to about 1/100 as much as the amount in ordinary color light-sensitive materials. With color light-sensitive materials containing a reduced amount of silver halide, suitable color images can be obtained by, for example, halogenation-bleaching silver deposits formed by color development and again conducting color development to increase the amount of dye produced (for example, U.S. Pat. Nos. 2,623,822, 2,814,565, etc.), or by employing a development processing utilizing color intensification using peroxides or cobalt complex salts to increase the amount of dye produced (for example, West German Patent Application (OLS) No. 2,357,694, U.S. Pat. Nos. 3,674,490, 3,761,265, West German Patent Application (OLS) Nos. 2,044,833, 2,056,359, 2,056,360, 2,226,770, Japanese Patent Application (OPI) Nos. 9728/73 and 9729/73, etc.).

The 2-equivalent magenta coupler of this invention can be used together with other magenta couplers, as described in, for instance, U.S. Pat. Nos. 2,439,098, 2,369,489, 2,600,788, 3,558,319, 2,311,081, 3,419,391, 3,214,437, 3,006,759, 2,725,292, 3,408,194, 2,908,573, 3,519,429, 3,615,506, 3,432,521, 3,152,896, 3,062,653, 3,582,322, 2,801,171, 3,311,476, British Pat. No. 956,261, Japanese Patent Publication Nos. 2016/69 and 19032/71, Japanese Patent Application Nos. 114445/72, 56050/73, 45971/73, 21454/73, 108798/73, and 114446/72, with the magenta-colored couplers, as described in U.S. Pat. Nos. 2,983,608, 2,455,170, 2,725,292, 3,005,712, 3,519,429, and 2,688,539, British Pat. Nos. 800,262 and 1,044,778, and Belgian Patent 676,691, with the so-called development inhibitor releasing type couplers capable of imagewise releasing development inhibiting compounds at development, such as, for instance, the monothio type couplers as described in U.S. Pat. Nos. 3,227,550 and 3,227,554 and British Pat. No. 953,454, the o-aminophenylazo type couplers as described in U.S. Patent 3,148,062, and the couplers as described in Japanese Patent Publication No. 8750/72 and German Patent Application (OLS) No. 2,163,811, and also with the hydroquinone releasing development inhibiting compounds as described in U.S. Pat. No. 3,297,445 and British Pat. No. 1,058,606.

One or more of the above-described couplers and the like can be employed in the same layer to achieve the properties required for light-sensitive materials and, of course, the same compound can be incorporated in two or more different layers. In general, the couplers are coated at a coverage of about $1\times10^{-4}$ to $5\times10^{-3}$ mol/m$^2$, preferably $3\times10^{-4}$ to $2\times10^{-3}$ mol/m$^2$.

The light-sensitive material of the present invention advantageously contains a p-substituted phenol derivative in an emulsion layer or an adjacent layer for the purpose of improving the light fastness of the magenta dye formed or of preventing yellowing or print-out of a coupler remaining in the unexposed areas, color fogging, or the like. Particularly effective p-substituted phenol derivatives are the hydroquinone derivatives described in U.S. Pat. Nos. 2,360,290, 2,418,613, 2,675,314, 2,701,197, 2,704,713, 2,710,801, 2,728,659, 2,732,300, 2,735,765, 2,816,038; the gallic acid derivatives as described in U.S. Pat. Nos. 3,457,079, 3,069,262 and Japanese Patent Publication No. 13496/68; the p-alkoxyphenol derivatives as described in U.S. Pat. No. 2,735,765 and Japanese Patent Application (OPI) No. 4738/72; and p-hydroxyphenol derivatives as described in U.S. Pat. Nos. 3,342,300, 3,573,050, 3,574,627 and Japanese Patent Publication No. 20977/74.

The silver halide emulsion which can be used in this invention can be suitably selected from various kinds of photographic emulsions depending on the end-use purposes of the photographic materials. Suitable silver halides which can be used in this invention are silver chloride, silver chlorobromide, silver bromide, silver iodobromide, and silver chloroiodobromide. Also, suitable binders for the silver halide emulsions which can be used in this invention are gelatin, gelatin derivatives (e.g., the acrylated gelatin as described in U.S. Pat. No. 3,118,766 and the graft gelatin having as the branch component a vinyl monomer such as acrylic acid as described in U.S. Pat. No. 2,831,767), casein, albumin, agar agar, sodium alginate, starch, cellulose derivatives (e.g., carboxymethyl cellulose and hydroxyethyl cellulose), vinyl alcohol, vinylpyrrolidone, polyacrylamide, and the like.

The silver halide emulsions used in this invention can be prepared by a single jet method, a double jet method, a control double jet method, and further the halogen conversion method as described in British Pat. No. 635,841 and U.S. Pat. No. 3,622,318.

The silver halide emulsion used in this invention can be sensitized by the natural sensitizers present in gelatin, by a sulfur sensitizer, by a reductive sensitizer, and by a noble metal salt using conventional techniques.

The silver halide emulsion can contain an anti-fogging agent or a stabilizer such as 1-phenyl-5-mercaptotetrazole, 5-methyl-7-hydroxy-1,3,4,7a-tetraazaindene, etc. Also, the silver halide emulsion can contain a sensitizing dye such as a cyanine dye, a merocyanine dye, etc. The silver halide emulsion can contain a coating aid such as saponin, polyethyleneglycol monolauryl ether, etc. Furthermore, the silver halide emulsion can contain a thickener such as polystyrenesulfonic acid, etc., an ultraviolet absorber such as 2-(2-hydroxy-3,5-di-sec-butylphenyl)-5-methoxybenzotriazole, 4-methoxy-α-cyanocinnamic acid-n-dodecyl ester, etc., an antioxidant or a reducing agent such as sodium bisulfite, ascorbic acid, aminophenols, pyrogallols, gallic acids, catechols, resorcinols, and dihydroxynaphthalenes, and an irradiation preventing dye such as an oxonol dye and a styryl dye, and other conventional photographic additives, if desired.

The photographic light-sensitive material of the present invention comprises a support having thereon a silver halide emulsion layer containing a 2-equivalent magenta coupler in accordance with the present invention. One embodiment of the photographic light-sensitive material of the present invention comprises a multilayered, multicolored photographic light-sensitive material comprising a support having thereon a blue-sensitive silver halide emulsion layer containing a yellow color-forming coupler, a green-sensitive silver halide emulsion layer containing a magenta color-forming coupler in accordance with the present invention, and a red-sensitive silver halide emulsion layer containing a cyan color-forming coupler. Known blue-sensitive silver halide emulsions and the red-sensitive silver halide emulsions can be appropriately used. Open-chain type ketomethylene compounds represented by benzoylacetanilides and pivaloylacetanilides can advantageously be used as yellow color-forming couplers. Phenolic or naphtholic compounds can advantageously be used as cyan color-forming couplers. These color-forming couplers can contain a coupling off group on the carbon atom of the coupling position. These color-forming couplers are desirably non-diffusible.

The photographic light-sensitive material of the present invention can have, in addition to the aforesaid silver halide emulsion layers, light-insensitive auxiliary layers such as a protective layer, a filter layer, intermediate layers, an antihalation layer, and a backing layer.

The hydrophilic polymer material, particularly gelatin constituting the layers of the photographic light-sensitive material of the present invention can be hardened by various cross-linking agents. For example, although an inorganic compound such as a chromium salt and a zirconium salt, and an aldehyde type cross-linking agent such as mucochloric acid, 2-phenoxy-3-chloromalealdehydic acid, etc., as described in Japanese Patent Publication No. 1872/71 can be used, a non-aldehyde type cross-linking agent, for example, a polyepoxy compound as described in Japanese Patent Publication No. 7133/59, a poly(1-aziridinyl) compound as described in Japanese Patent Publication No. 8790/62, an active halogen compound as described in U.S. Pat. Nos. 3,362,827 and 3,325,287, etc., are particularly useful.

In the photographic light-sensitive materials of the present invention, any materials usually used as supports for photographic light-sensitive materials can be suitably used. For instance, preferred examples of such supports are cellulose ester films such as cellulose nitrate films, cellulose acetate films, etc., polyester films such as polyethylene terephthalate films, etc., polyvinyl chloride films, polyvinyl acetal films, pylystyrene films, polycarbonate films, polyamide films such as nylon films, baryta-coated papers, α-olefin polymer-coated papers, etc.

The photographic light-sensitive material of the present invention can be suitably used for various purposes such as color positive films, color negative films, color reversal films, color photographic printing papers, etc.

The color photographic light-sensitive material of the present invention provides magenta color images having excellent spectral properties and image fastness when imagewise exposed in a conventional manner and processed using conventional color processing steps. The main color processing steps are color development, bleach, and fix and if desired a wash step can be inserted between the steps.

A useful color developer which can be used for developing the color photographic material of this invention is an alkaline aqueous solution containing a color developing agent in a pH range of 9.5 to 12.2. Examples of color developing agents which can be used in the color developer include conventional primary aromatic amine color developing agents such as phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 4-amino-3-methyl-N-ethyl-N-β-methanesulfonamidoethylaniline, 4-amino-N,N-diethylaniline, 4-amino-3-methoxy-N,N-diethylaniline, 4-amino-3-methyl-N-ethyl-N-β-methoxyethylaniline, 4-amino-3-methoxy-N-ethyl-N-β-methoxyethylaniline, 4-amino-3-β-methanesulfonamidoethyl-N,N-diethylaniline), and p-aminophenols (e.g., 4-aminophenol, 2,6-dichloro-4-aminophenol, 2-bromo-4-aminophenol, and 2,6-diiodo-4-aminophenol).

The color developer can contain further conventional additives such as, for instance, an alkali metal sulfite, an alkali metal carbonate, an alkali metal bisulfite, a bromide, an iodide, an alkaline buffer, etc. Furthermore, if desired, the color developer can contain a dye forming coupler, a competitive coupler, an antifoggant, a hardening agent, an antioxidant, a thickener, etc.

Some of the advantages of the present invention are as follows.

(1) Since the amount of silver necessary for obtaining the same magenta color image density can be reduced, the thickness of the light-sensitive layer containing the coupler can be reduced, thus improving the sharpness of the images.

(2) The heat fastness of the magenta color images produced using the coupler of the present invention is improved.

(3) The production cost can be reduced through the reduction in the amount of silver halide necessary.

(4) Magenta couplers stable to chemicals such as formaldehyde or acetone can be obtained.

(5) Couplers having a high developing activity can be obtained.

Color images with less fog and stain and with excellent other photographic properties can be obtained.

(7) Silver halide color photographic light-sensitive materials having excellent storage stability can be obtained using the coupler of the present invention.

(8) The conversion of the coupler to the dye is improved using the coupler of the present invention.

(9) Silver halide color photographic light-sensitive materials having high sensitivity can be obtained using the coupler of the present invention.

The light-sensitive materials of the present invention having the above-described advantages are extremely useful in the field of color photography.

The present invention will now be illustrated in more detail by the following non-limiting examples of preferred embodiments of the present invention.

EXAMPLE 1

A solution, prepared by heating at 60° C. and dissolving a mixture comprising 18.5 g of Coupler (1) in accordance with the present invention, 20 ml of dioctyl butyl phosphate and 60 ml of ethyl acetate, was added to 250 ml of a 60° C. aqueous solution containing 2.5 g of gelatin and 0.75 g of sodium dodecylbenzenesulfonate. The resulting solution was mechanically vigorously stirred using a homogenizer to obtain a coupler emulsion dispersion. This emulsion dispersion was mixed with 200 g of a photographic emulsion containing $11.2\times10^{-2}$ mol of silver chlorobromide (silver bromide: 45 mol%, silver chloride: 55 mol%) and 20 g of gelatin. Then, 10 ml of a 3% acetone solution of triethylenephosphoramide was added thereto as a hardener and, after adjusting the final pH to 6.5, the solution was coated on a cellulose triacetate film support in a dry thickness of 4.5μ (Film A). This film contained $1.56\times10^{-3}$ mol/m$^2$ of Coupler (1) and $6.3\times10^{-3}$ mol/m$^2$ of silver chlorobromide. 21.8 g of Coupler (2) in accordance with the present invention and, as comparison couplers, 19.6 g of 1-(2,4,6-trichlorophenyl)-3-{3-[2-(2,4-di-tert-amylphenoxy)butyramido]benzamido}-5-oxo-2-pyrazoline (Coupler L), 23.4 g of 1-(2,4,6-trichlorophenyl)-3-{3-[2-(3-pentadecylphenoxy)-butyramido]benzamido}-4-(1-imidazolyl)-5-oxo-2-pyrazoline (Coupler M), 18.1 g of 1-(2,4,6-trichlorophenyl)3-[α-(2,4-di-tert-amylphenoxy)butyramido]-4-(1-imidazolyl)5-oxo-2-pyrazoline (Coupler N) and 25.1 g of (2,6-dichloro-4-methoxyphenyl)-3-{3-[α-(3-tert-butyl-4-hydroxyphenoxy)tetradecanamido]benzamido}-4-(2-phenyl-1-imidazolyl)-5-oxo-2-pyrazoline (Coupler O) were dispersed respectively in place of the above-described Coupler (1) in the same manner as described above, mixed with 200 g of a silver halide emulsion having the same composition as above with respect to Coupler (2), Coupler (M), Coupler (N), and Coupler (O) and with 400 g of a silver halide emulsion having the same composition as above with respect to Coupler (L) respectively, and coated on a film in a dry thickness of 5.2μ, 5.0μ, 4.9μ, 5.1μ and 5.0μ respectively (Films B, C, D, E and F). The coated amounts of coupler and silver chlorobromide emulsion on the films were shown in Table 1 below.

These films were subjected to stepwise exposure and the following development processing.

| Color Development Processing: | | | |
|---|---|---|---|
| 1. | Color Development | 21° C. | 12 min |
| 2. | Washing | " | 30 sec |

-continued

| Color Development Processing: | | | |
|---|---|---|---|
| 3. | First Fixing | " | 4 min |
| 4. | Washing | " | 4 min |
| 5. | Bleaching | " | 8 min |
| 6. | Washing | " | 4 min |
| 7. | Second Fixing | " | 4 min |
| 8. | Washing | " | 6 min |

The processing solutions had the following compositions.

| Color Developer | |
|---|---|
| Sodium Hexametaphosphate | 2 g |
| Sodium Sulfite (anhydrous) | 2 g |
| Sodium Carbonate (monohydrate) | 27.5 g |
| Potassium Bromide | 0.5 g |
| Hydroxylamine Sulfate | 2.5 g |
| N-Ethyl-N-(β-methanesulfonamidoethyl)-3-methyl-4-aminoaniline Sesquisulfate | 2.5 g |
| Water to make | 1 l |
| | pH = 10.7 |

| Fixing Solution | |
|---|---|
| Sodium Thiosulfate (hexahydrate) | 80 g |
| Sodium Sulfite (anhydrous) | 5 g |
| Borax | 6 g |
| Glacial Acetic Acid | 4 ml |
| Potassium Alum | 7 g |
| Water to make | 1 l |
| | pH = 4.5 |

| Bleaching Bath | |
|---|---|
| Potassium Ferricyanide | 100 g |
| Potassium Bromide | 5 g |
| Boric Acid | 10 g |
| Borax | 5 g |
| Water to make | 1 l |
| | pH = 7.2 |

After processing, the optical density of these film samples was measured using green light. As a result, the photographic properties as shown in Table 1 were obtained.

TABLE 1

| Film | Coupler | Coated Amount (mol/m²) Coupler (M) | Coated Amount (mol/m²) Ag × (M) | Ag/Coupler (molar ratio) | Film Thickness | Fog | Gamma | Relative Sensitivity | Maximum Color Density |
|---|---|---|---|---|---|---|---|---|---|
| A | (1) | $1.56 \times 10^{-3}$ | $6.3 \times 10^{-3}$ | 4 | 4.5 | 0.02 | 3.5 | 94 | 3.54 |
| B | (2) | $1.55 \times 10^{-3}$ | $6.2 \times 10^{-3}$ | 4 | 5.2 | 0.02 | 4.0 | 100 | 3.70 |
| C | (L) | $1.56 \times 10^{-3}$ | $12.7 \times 10^{-3}$ | 8 | 5.0 | 0.02 | 2.1 | 81 | 2.20 |
| D | (M) | $1.55 \times 10^{-3}$ | $6.4 \times 10^{-3}$ | 4 | 4.9 | 0.02 | 3.1 | 86 | 3.10 |
| E | (N) | $1.55 \times 10^{-3}$ | $6.3 \times 10^{-3}$ | 4 | 5.1 | 0.02 | 3.2 | 79 | 3.00 |
| F | (O) | $1.56 \times 10^{-3}$ | $6.4 \times 10^{-3}$ | 4 | 5.0 | 0.02 | 3.0 | 80 | 2.80 |

The results in Table 1 show that the coupler according to the present invention provided higher sensitivity, higher gradation and higher maximum color density even when the ratio of silver halide/coupler was reduced to about ½. Also, in comparison with Films D, E and F, the coupler according to the present invention indicated superior color forming properties to Couplers M, N and O having an imidazolyl group as a coupling off group (included within the scope of German Pat. No. 2,536,191).

EXAMPLE 2

The following processings were conducted after exposure of Films A, B, C, D, E and F described in Example 1.

| Color Development Processing | | |
|---|---|---|
| 1. Color Development | 30° C. | 4 min |
| 2. Bleach-Fixing | " | 2 min |
| 3. Washing | " | 2 min |
| 4. Stabilizing Bath | " | 2 min |

The photographic properties of the thus obtained films are shown in Table 2 below.

Furthermore, as aqueous stabilizing baths a formaldehyde free Stabilizing Bath (a) and Stabilizing Bath (b) containing 1% of a 40% by weight aqueous solution of formaldehyde were used. With the two films having been processed, the reduction ratio of the density based on the initial density, after leaving the films at 80° C. for 2 weeks was determined and the results are tabulated in Table 3 below. Also, the occurrence of stain under the same condition as above are tabulated in Table 4 below.

| Color Developer | |
|---|---|
| Sodium Metaborate | 25 g |
| Sodium Sulfite | 2 g |
| Hydroxylamine (sulfate) | 2 g |
| Potassium Bromide | 0.5 g |
| 6-Nitrobenzimidazole (nitrate) | 0.02 g |
| Sodium Hydroxide | 4 g |
| Diethylene Glycol | 20 ml |
| 4-(N-Ethyl-N-β-methanesulfonamidoethyl)amino-2-methylaniline Sesquisulfate | 8 g |
| Water to make | 1 l |
| | pH = 10.2 |

| Bleach-Fixing Solution | |
|---|---|
| Ferric Salt of Ethylenediaminetetraacetic Acid | 45 g |
| Ammonium Thiocyanate | 10 g |
| Sodium Sulfite | 10 g |
| Ammonium Thiosulfate (60% aq. soln.) | 100 ml |
| Sodium Ethylenediaminetetraacetate | 5 g |
| Water to make | 1 l |
| | pH = 6.9 |

| Stabilizing Bath (a) | |
|---|---|
| Tartaric Acid | 10 g |
| Zinc Sulfate | 10 g |
| Sodium Metaborate | 20 g |

-continued

| Stabilizing Bath (a) | |
|---|---|
| Water to make | 1 l |

| Stabilizing Bath (b) | |
|---|---|
| Tartaric Acid | 10 g |
| Zinc Sulfate | 10 g |
| Sodium Metaborate | 20 g |
| Formalin (40%) | 10 ml |
| Water to make | 1 l |

TABLE 2

Photographic Properties (using Stabilizing Bath (a))

| Film | Coupler | Fog | Gamma | Maximum Color Density |
|---|---|---|---|---|
| A | (1) | 0.03 | 3.42 | 3.51 |
| B | (2) | 0.03 | 3.95 | 3.65 |
| C | (L) | 0.03 | 1.91 | 2.05 |
| D | (M) | 0.03 | 2.94 | 3.05 |
| E | (N) | 0.03 | 2.55 | 3.00 |
| F | (O) | 0.03 | 2.21 | 2.95 |

TABLE 3

Fastness of Color Images (after storage for 2 weeks at 80° C.)

| Film | Stabilizing Bath | Reduction Ratio (%) in Color Image Density Initial Density 0.5 | 1.0 | 2.0 |
|---|---|---|---|---|
| A | a | 10 | 6 | 5 |
| | b | 8 | 5 | 5 |
| B | a | 9 | 7 | 6 |
| | b | 8 | 5 | 4 |
| C | a | 65 | 43 | 10 |
| | b | 10 | 8 | 6 |

TABLE 4

Occurrence of Stain in Unexposed Areas (using Stabilizing Bath (a) and after storage for 2 weeks at 80° C.)

| Film | Initial Density (B) | Density (B) after Storage for 2 Weeks at 80° C. |
|---|---|---|
| A | 0.02 | 0.03 |
| B | 0.02 | 0.03 |
| D | 0.02 | 0.15 |
| E | 0.02 | 0.15 |
| F | 0.02 | 0.15 |

The results in Table 2 show that, even when a strong oxidizing agent used in the development processing of Example 1 is not used, sufficient color forming properties can be obtained using the film containing the couplers according to the present invention. The results in Table 3 show that Films A and B provide sufficient heat fatsness even without a stabilization using formaldehyde in a conventional manner. The results in Table 4 show that the occurrence of stain in Films A and B is extremely small in comparison with Films D, E and F each containing known 2-equivalent magenta coupler, which proves the stability of the couplers according to the present invention.

While the invention has been described in detail and with reference to specific embodiments thereof, it will be apparent to one skilled in the art that various changes and modifications can be made therein without departing from the spirit and scope thereof.

What is claimed is:

1. A color photographic light-sensitive material comprising a support having thereon at least one emulsion layer containing a 5-pyrazolone magenta coupler represented by the formula (I):

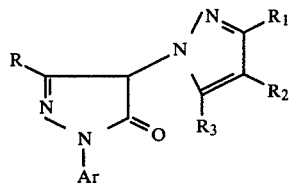

(I)

wherein R represents an acylamino group, an anilino group or a ureido group; $R_1$, $R_2$ and $R_3$, which may be the same or different, each represents a hydrogen atom, a halogen atom, an alkyl group, an alkenyl group, a cycloalkyl group, an aralkyl group, an alkoxy group, an aryloxy group, a carboxy group, an aryl group or a heterocyclic group and $R_1$ and $R_2$ may combine to form a 2-indazolyl group, provided that $R_1$, $R_2$ and $R_3$ are not hydrogen atoms at the same time; and Ar represents a phenyl group which may be substituted with one or more halogen atoms, alkyl groups, alkoxy groups or cyano groups.

2. The light-sensitive material of claim 1, wherein R represents an acylamino group selected from the group consisting of an acetamido group, a benzamido group, a 3-[α-(2,4-di-tert-amylphenoxy)butyramido]benzamido group, a 3-[α(2,4-di-tert-amylphenoxy)acetamido]benzamido a 3-[α-(3-pentadecylphenoxy)butyramido]benzamido group, an α-(2,4-di-tert-amylphenoxy)-butyramido group, and an α-(3-pentadecylphenoxy)-butyramido group.

3. The light-sensitive material of claim 1, wherein R represents an anilino group selected from the group consisting of an anilino group, a 2-chloroanilino group, a 2,4-dichloroanilino group, a 2-chloro-5-tetradecanamidoanilino group, a 2-chloro-5-(2-octadecenylsuccinimido)anilino group, a 2-chloro-5-[α-(3-tert-butyl-4-hydroxy)tetradecanamido]anilino group, a 2-chloro-5-tetradecyloxycarbonylanilino group, a 2-chloro-5-(N-tetradecylsulfamoyl)anilino group, and a 2,4-dichloro-5-tetradecyloxyanilino group.

4. The light-sensitive material of claim 1, wherein R represents a ureido group selected from the group consisting of a 3-[(2,4-di-tert-amylphenoxy)acetamido]-phenylurido group, a phenylureido group, a methylureido group, an octadecylureido group, and a 3-tetradecanamidophenylureido group.

5. The light-sensitive material of claim 1, wherein the 4-position of said 5-pyrazolone ring is substituted by a moiety of the formula (II):

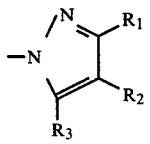

(II)

wherein $R_1$, $R_2$ and $R_3$ in the formula (II), which may be the same or different, each represents a hydrogen atom, a halogen atom, an alkyl group, an alkenyl group, a cycloalkyl group, an aralkyl group, an alkoxy group, an aryloxy group, a carboxy group, an aryl group or a heterocyclic group provided that $R_1$, $R_2$ and $R_3$ are not hydrogen atoms at the same time.

6. The light-sensitive material of claim 1, wherein the 4-position of said 5-pyrazolone ring is substituted by a moiety represented by the formula (III):

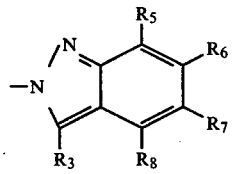

(III)

wherein $R_5$, $R_6$, $R_7$ and $R_8$ which may be the same or different, each represents a hydrogen atom, an alkyl group, an alkenyl group, a cycloalkyl group or an aralkyl group and $R_3$ in the formula (III) is as defined for $R_3$ in claim 1.

7. The light-sensitive material of claim 1, wherein said 5-pyrazolone magenta coupler is present in a silver halide emulsion layer.

8. The light-sensitive material of claim 7, wherein said emulsion layer is a green-sensitive emulsion layer.

9. The light-sensitive material of claim 8 comprising a support having thereon at least one blue-sensitive silver halide emulsion layer containing a yellow color forming coupler, said green-sensitive silver halide emulsion layer containing said magenta color forming coupler and a red-sensitive silver halide emulsion layer containing a cyan color forming coupler.

10. The light-sensitive material of claim 9, wherein said color forming couplers are non-diffusible.

11. The light-sensitive material of claim 5, wherein said moiety represented by the formula (II) is selected from the group consisting of 3,5-dimethylpyrazolyl, 4-methylpyrazolyl, 4-chloropyrazolyl, 3-methyl-5-chloropyrazolyl, 4-t-butylpyrazolyl, 4-benzylpyrazolyl, 4-methoxypyrazolyl, 4-octyloxypyrazolyl, 4-carboxypyrazolyl, 4-phenylpyrazolyl, 4-octylpyrazolyl, 4-(2-thiazolyl)pyrazolyl, 4-carboxymethylpyrazolyl, 4-ethyloxycarbonylmethylpyrazolyl, 3,5-dichloropyrazolyl, 4-bromopyrazolyl, 4-ethylpyrazolyl, 3-chloropyrazolyl, 4-n-butylpyrazolyl and 4-n-hexadecylpyrazolyl.

12. The light-sensitive material of claim 1, wherein said magenta coupler is a complex coupler of the formula (I).

13. The light-sensitive material of claim 1, wherein Ar or R contains 8 or more carbon atoms.

14. The light-sensitive material of claim 1, wherein Ar or R contains a water solubilitizing group.

15. The light-sensitive material of claim 7, wherein said silver halide emulsion layer containing said magenta coupler of the formula (I) contains silver halide in an amount of about $1\times10^{-3}$ to $3\times10^{-1}$ mol/m$^2$.

16. The light-sensitive material of claim 15, wherein said coupler of the formula (I) is present in an amount of about $2\times10^{-1}$ to $5\times10^{-1}$ mol per mol of silver.

17. A process for forming a color photographic image which comprises processing a silver halide color photographic light-sensitive material in the presence of a 5-pyrazolone magenta coupler represented by the following formula (I):

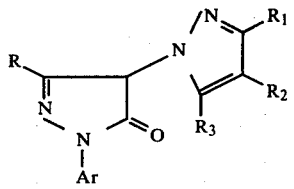

(I)

wherein R represents an acylamino group, an anilino group or a ureido group; $R_1$, $R_2$ and $R_3$, which may be the same or different, each represents a hydrogen atom, a halogen atom, an alkyl group, an alkenyl group, a cycloalkyl group, an aralkyl group, an alkoxy group, an aryloxy group, a carboxy group, an aryl group or a heterocyclic group wherein said group may be substituted and $R_1$ and $R_2$ may combine to form a 2-imidazolyl group, provided that $R_1$, $R_2$ and $R_3$ are not hydrogen atoms at the same time; and Ar represents a phenyl group which may be substituted with one or more halogen atoms, alkyl groups, alkoxy groups or cyano groups.

18. The process of claim 17, wherein said group connected to the 4-position of the pyrazolone ring is represented by the formula (II):

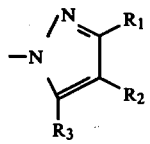

(II)

wherein $R_1$, $R_2$ and $R_3$ in the formula (II), which may be the same or different, each represents a hydrogen atom, a halogen atom, an alkyl group, an alkenyl group, a cycloalkyl group, an aralkyl group, an alkoxy group, an aryloxy group, a carboxy group, an aryl group or a heterocyclic group, provided that $R_1$, $R_2$ and $R_3$ are not hydrogen atoms at the same group.

19. The process of claim 17, wherein said group connected to the 4-position of the pyrazolone ring is represented by the formula (III):

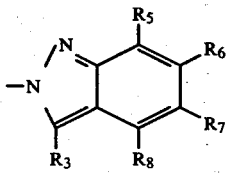

(III)

wherein $R_5$, $R_6$, $R_7$ and $R_8$, which may be the same or different, each represents a hydrogen atom, an alkyl group, an alkenyl group, a cycloalkyl group or an aralkyl group and $R_3$ in the formula (III) is as defined for $R_3$ in claim 17.

20. The process of claim 17, wherein said 5-pyrazolone magenta coupler is present in a silver halide color photographic material.

21. The process of claim 17, wherein said 5-pyrazolone magenta coupler is present in a color developer.

22. The process of claim 17 which comprises blixing said color photographic material after color development.

23. The process of claim 17, wherein said process is a diffusion transfer process.

24. The light-sensitive material of claim 1, wherein $R_1$ to $R_3$ may bear one or more substituents selected from the group consisting of a halogen atom, a nitro group, a cyano group, a thiocyano group, an aryl group, an alkoxy group, an aryloxy group, a carboxy group, an alkylcarbonyl group, an arylcarbonyl group, an alkoxycarbonyl group, an aryloxycarbonyl group, a sulfo group, an acyloxy group, a sulfamoyl group, a carbamoyl group, an acylamino group, a diacylamino group, a ureido group, a thioureido group, a urethane group, a thiourethane group, a sulfonamide group, a heterocyclic group, an arylsulfonyloxy group, an alkylsulfonyloxy group, an arylsulfonyl group, an alkylsulfonyl group, an arylthio group, an alkylthio group, an alkylsulfinyl group, an arylsulfinyl group, an alkylamino group, a dialkylamino group, an anilino group, an N-alkylanilino group, an N-arylanilino group, an N-acylanilino group, a hydroxy group, a mercapto group and when $R_1$ to $R_3$ represent an aryl group or a heterocyclic group, they may be further substituted by an alkyl group, an alkenyl group, a cycloalkyl group, or an aralkyl group.

25. The process of claim 17, wherein $R_1$ to $R_3$ may be substituted by one or more substituents selected from the group consisting of a halogen atom, a nitro group, a cyano group, a thiocyano group, an aryl group, an alkoxy group, an aryloxy group, a carboxy group, an alkylcarbonyl group, an arylcarbonyl group, an alkoxycarbonyl group, an aryloxycarbonyl group, a sulfo group, an acyloxy group, a sulfamoyl group, a carbamoyl group, an acylamino group, a diacylamino group, a ureido group, a thioureido group, a urethane group, a thiourethane group, a sulfonamido group, a heterocyclic group, an arylsulfonyloxy group, an alkylsulfonyloxy group, an arylsulfonyl group, an akylsulfonyl group, an arylthio group, an alkylthio group, an alkylsulfinyl group, an arylsulfinyl group, an alkylamino group, a dialkylamino group, an anilino group, an N-alkylanilino group, an N-arylanilino group, an N-acylanilino group, a hydroxy group, a mercapto group and when $R_1$ to $R_3$ represent an aryl group or a heterocyclic group, they may be further substituted by an alkyl group, an alkenyl group, a cycloalkyl group or an aralkyl group.

* * * * *